United States Patent [19]

LaFleur et al.

[11] Patent Number: 4,596,040

[45] Date of Patent: Jun. 17, 1986

[54] LARGE BULK BAG

[75] Inventors: Arthur E. LaFleur; Arnie LaFleur; Lee LaFleur, all of Manistee, Mich.

[73] Assignee: Custom Packaging Systems, Manistee, Mich.

[21] Appl. No.: 528,604

[22] Filed: Sep. 1, 1983

Related U.S. Application Data

[63] Continuation-in-part of Ser. No. 430,809, Sep. 30, 1982, abandoned.

[51] Int. Cl.[4] ..... B65D 33/16

[52] U.S. Cl. ..... 383/7; 383/42; 383/72

[58] Field of Search ..... 383/42, 6, 8, 52, 59, 383/61, 72, 86

[56] References Cited

U.S. PATENT DOCUMENTS

| | | | |
|---|---|---|---|
| 2,196,185 | 4/1940 | Belcher | 383/6 |
| 2,210,937 | 8/1940 | Geimer | 383/8 |
| 2,656,093 | 10/1953 | Smith | 383/6 |
| 4,211,266 | 7/1980 | Massey | 383/6 |
| 4,300,608 | 11/1981 | Cuthbertson | 383/7 |

FOREIGN PATENT DOCUMENTS

| | | | |
|---|---|---|---|
| 2161530 | 7/1973 | France | 383/7 |
| 1536237 | 12/1978 | United Kingdom | 383/6 |
| 1581437 | 12/1980 | United Kingdom | 383/119 |

*Primary Examiner*—Joseph Man-Fu Moy

*Attorney, Agent, or Firm*—Barnes, Kisselle, Raisch, Choate, Whittemore & Hulbert

[57] ABSTRACT

A large bulk bag formed from a tubular blank of woven fabric having inwardly folded gusset panels along opposite side edges. While in the flattened condition, the blank is sewn along predetermined stitch lines and severed at predetermined portions so that, when the stitched and severed blank is expanded, it forms a bag of rectangular cross section having a closable spout at one or both ends. If a liner is to be used in the bag, the liner is formed from a gussetted tubular blank and sealed and severed along lines corresponding to the stitch severing lines on the bag so that the flat liner can be inserted into the flattened bag with the gussetted portions of the bag and liner interfitting in interleaved relation and the spout on the liner extending through the spout on the bag.

25 Claims, 25 Drawing Figures

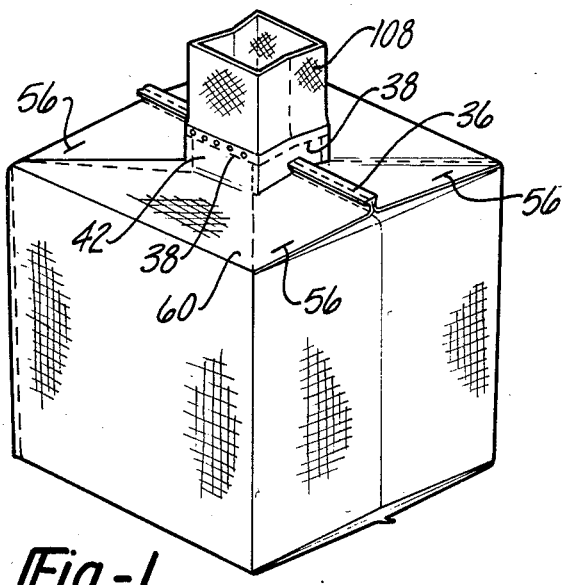
Fig-1
Fig-5
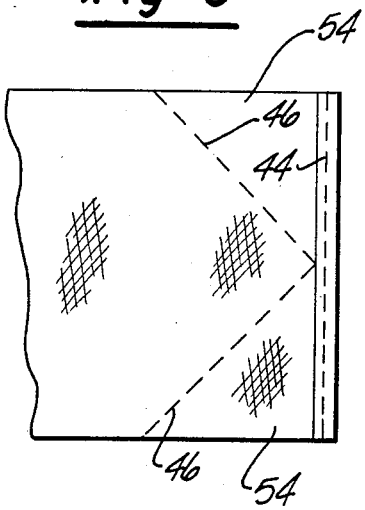
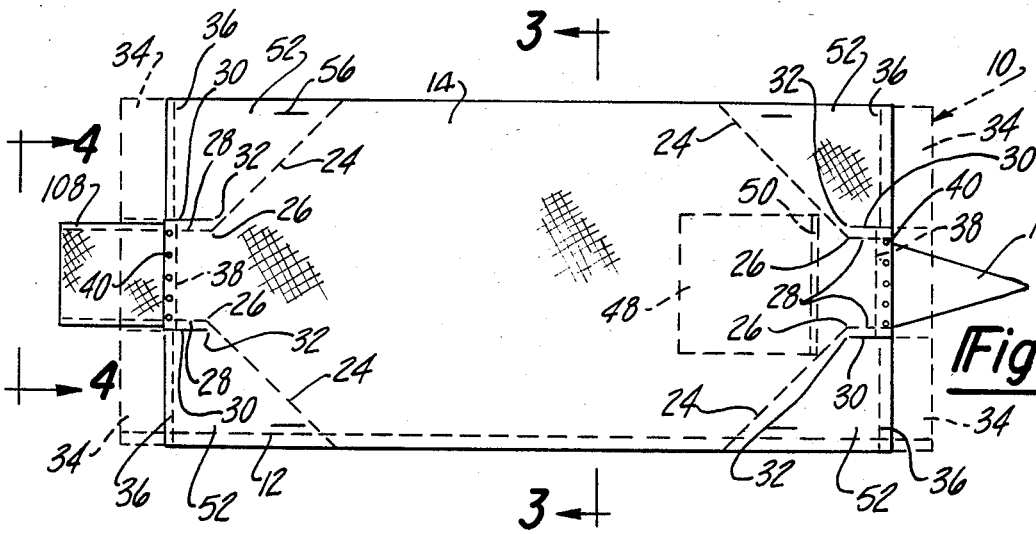
Fig-2
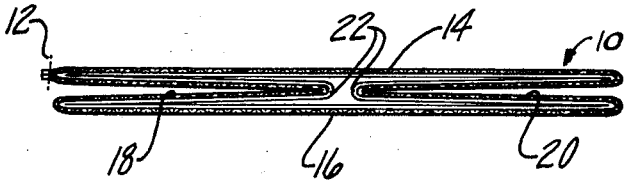
Fig-3
Fig-4
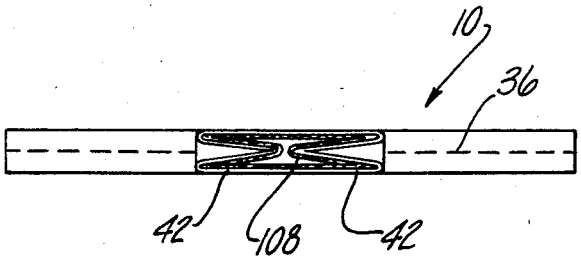

Fig-7
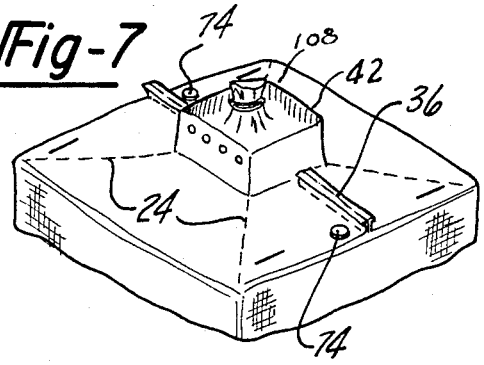
Fig-6
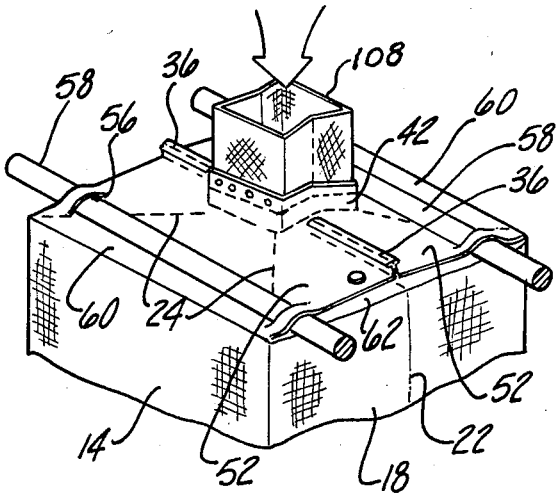
Fig-8
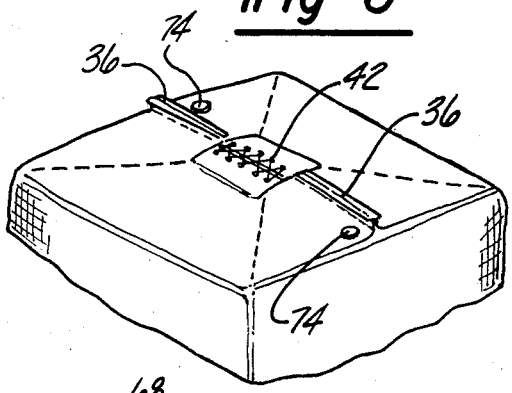
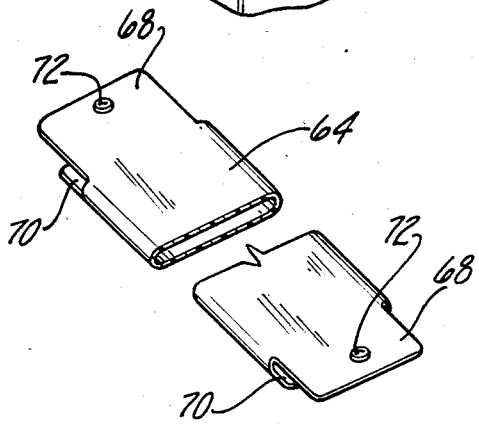
Fig-9
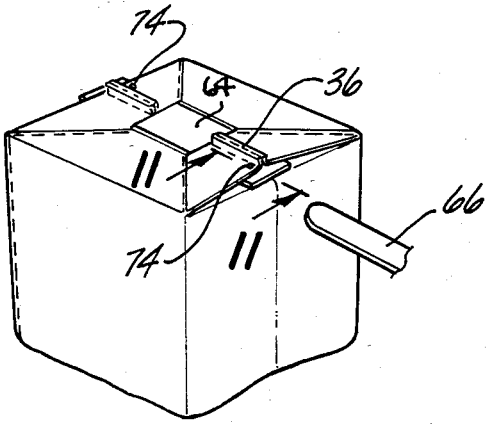
Fig-10
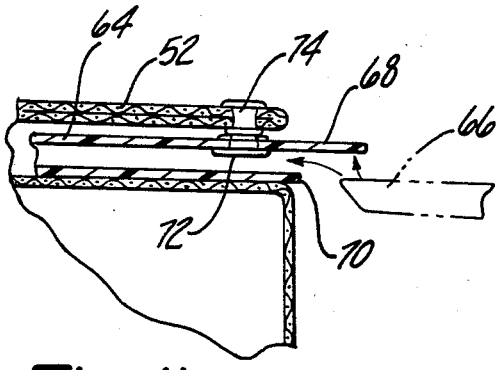
Fig-11

LARGE BULK BAG

This application is a continuation-in-part of applicant's prior application Ser. No. 06/430,809, filed Sept. 30, 1982 and now abandoned.

This invention relates to a shipping and storage container and, more specifically, to a large bulk, collapsible container in the form of a bag made of a woven fabric.

Many products, such as granular and liquid materials, are shipped and stored in large bulk bags adapted to hold as much as a ton or more of material. The use of bags for this purpose has become popular recently because the bags can be shipped from the manufacturer to the material shipper in a generally flat condition and, if properly designed, when empty can be returned by the user to the shipper in the same generally flat condition for reuse.

A fabric bag used in the above manner has to fulfill several practical requirements. It is of primary importance that the construction of the bag be such as to sustain relatively heavy loads. At the same time, it is essential that the bag is adapted to be folded or collapsed to a compact flat form. Frequently, because of the nature and quantity of material shipped in such bags, the bags should also be designed so that they can be easily filled and emptied of their contents. It is also desirable that such bags be designed so that, when filled, they are free standing and capable of being stacked vertically upon another. Such bags should preferably have some sort of attachment thereon which enable them to be lifted by the tines of a forklift truck. Furthermore, depending upon the type of material being shipped, some bags are also required to be moisture-proof or water resistant.

The primary object of this invention resides in the provision of a fabric bag which is economical to manufacture and which fulfills all of the above requirements.

A more specific object of the present invention resides in the provision of a fabric bag which can be folded into a flat compact form which, when filled, automatically assumes the desired cubical shape.

A further object of the invention is to provide a bag designed so that, when filled, it has rectangularly shaped top and bottom walls of high strength and an easily closeable filling spout at the top wall and, if desired, a spout at the bottom which can be readily opened to discharge the contents of the bag.

Another object of this invention is to provide a large bulk shipping bag so designed that it can be engaged with one or both tines of a forklift truck by the operator of the truck without further assistance.

Still another object of the present invention is to provide a bag of the type described with a top wall that is so designed as to impart high strength to the bag by a top panel construction which also provides a lift member generally engageable with one or both tines of a forklift truck.

Other objects, features and advantages of the present invention will become apparent from the following description and accompanying drawings, in which:

FIG. 1 is a perspective view of a bag according to the present invention in the expanded condition and with a liner therein;

FIG. 2 is a plan view of the bag in the flattened condition;

FIG. 3 is a sectional view taken along the line 3—3 in FIG. 2;

FIG. 4 is an end view of the flattened bag as seen in the direction of the arrow 4—4;

FIG. 5 is a fragmentary plan view showing a modified construction for the bottom of the bag;

FIG. 6 is a fragmentary perspective view illustrating the manner in which the bag is supported for filling;

FIG. 7 is a fragmentary perspective view illustrating the manner in which the spout of the inner liner is closed after the bag is filled;

FIG. 8 is a fragmentary perspective view illustrating the manner in which the spout on the bag is closed after being filled;

FIG. 9 is a perspective view, with parts broken away, showing the tube used for lifting the bag;

FIG. 10 is a perspective view of the bag illustrating the manner in which it is adapted to be lifted by the tine of a forklift truck;

FIG. 11 is a sectional view along the line 11—11 in FIG. 10;

Figure 12:
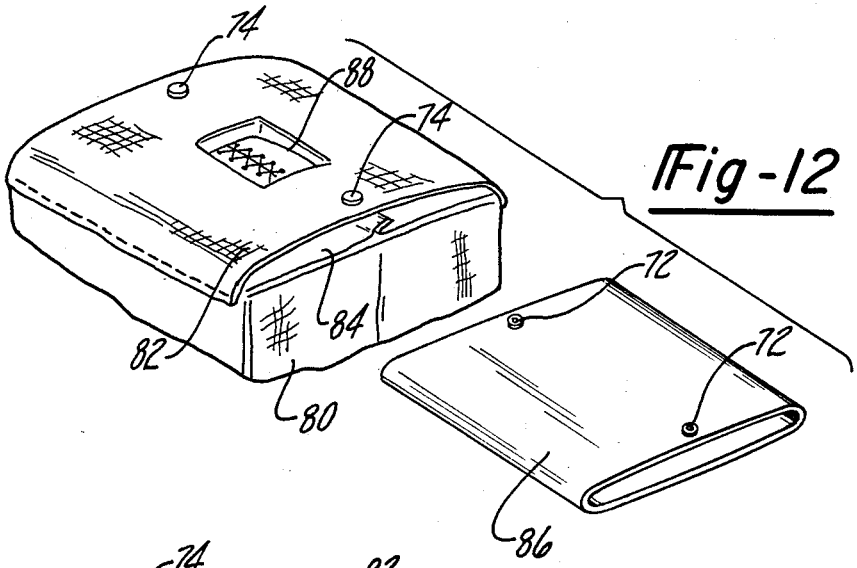
FIG. 12 is an exploded fragmentary perspective view of a modified form of lifting arrangement for the bag.

Referring first to FIG. 2, the bag of the present invention is formed from a tubular blank 10 of a woven fabric, such as burlap, canvas, polypropylene, etc. The woven fabric is formed into a tube by sewing the opposite side edges of the fabric together as at 12. The tubular blank comprises a pair of flat overlying panels 14,16 which are interconnected by inwardly folded gussets 18,20. The bag illustrated is generally square in cross section and, accordingly, each folded gusset 18 and 20 has a width which is approximately the same as the width of the flat panels 14,16. Thus, the fold lines 22 of gussets 18,20 extend lengthwise of the blank closely adjacent the longitudinal center line thereof.

In order to form the blank 10 into a bag of generally rectangular cross section the four corner portions of the bag are stitched diagonally on opposite sides of the blank as at 24. There are eight such lines of stitching, four extending through panel 14 and the adjacent underlying portions of gusset panels 18 and 20 and the other four extending through panel 16 and the adjacent portions of the overlying gusset panels 18 and 20. The stitch lines 24 extend symmetrically from the opposite side edges of the tubular blank inwardly and toward the adjacent end of the blank and terminate at the points 26 which are spaced apart on opposite sides of the longitudinal center line of the blank and which are also spaced inwardly from the opposite ends of the blank. Additional lines of stitching 28 extend from the points 26 lengthwise of the blank in parallel relation to the opposite ends of the blank. Panels 14,16 and the intermediate portions of gusset panels 18,20 are then slitted lengthwise from the opposite ends of the blank inwardly as at 30 along lines that are parallel to and spaced slightly laterally outwardly from the stitch lines 28. The severing lines 30 terminate at points 32 which are generally transversely aligned with the intersection points 26 between stitch lines 28 and stitch lines 24. Thereafter, at the opposite end portions 34 of the blank and laterally outwardly from the severing lines 30 the end portions of panels 14,16 and gusset panels 18,20 are folded over several times and stitched together as at 36. Preferably for the purpose of eliminating raw edges, the end portions of the flat panels 14,16 and the gusset panels 18,20 which extend between the severing lines 30 are also folded individually one or more times upon themselves and hemmed by stitching as at 38. If desired, eyelets or similar fasteners 40 can be secured to the edges which are hemmed at 38 on the two flat panels 14,16. It will be appreciated that all of the stitching and severing thus far described can be performed on the blank while it is in a flat condition with the gusset panels 18,20 folded inwardly as shown in FIG. 3. This represents simple sewing and cutting operations that can be performed quickly and economically even though the blank itself may be over six feet long and three feet wide.

When the bag is opened the portions of the panels 14,16 and gusset panels 18,20 which extend between stitch lines 28 form rectangularly-shaped spouts 42, the upper spout being illustrated in FIG. 1. If the bag is intended to be of the reuseable type, the spouts 42 are formed at both ends, as shown in FIG. 2. However, if the bag is of the type that would be used only once and discarded, or, depending upon the material with which the bag is filled, the bottom need not be formed with a spout. In this case the bottom of the blank may have the construction shown in FIG. 5. The end portion of the blank will be folded over one or more times upon itself and then stitched along the line 44. The four diagonal stitch lines 46, each of which extends through one of the flat panels 14,16, and the adjacent portion of the gusset panels 18,20 extend directly to the hemmed portion which is stitched at 44. Stitching 46 is performed before stitching 44.

As indicated previously, the bag illustrated in the drawings is generally square in horizontal section. If it is desired to form a bag of rectangular cross section with two opposite sides wider than the other two opposite sides, then the fold lines 22 between the gusset panels 18,20 would be located further laterally outwardly from the longitudinal center line of the blank than illustrated in FIG. 3. In any event, however, the lines of severing 30 would be located laterally outwardly of the fold lines 22 of the gusset panels 18,20. In a rectangular bag the wider side walls would be formed by panels 14,16 and the narrower end walls of the bag would be formed by the gusset panels 18,20. If a spout 42 is formed at both the upper and lower ends of the bag and the bag is used without a liner, then it is desirable, depending upon the material with which the bag is filled, to provide a valve closure panel at the bottom of the bag. In FIG. 2 the valve closure panel is designated 48 and is stitched solely to the inner face of the flat panel 14 as at 50. Valve panel 48 is sized to overlie the opening formed by the spout 42 at the lower end of the bag when the bag is filled.

It will be observed that when the tubular blank 10 is formed into the configuration shown in FIG. 2 the bag in the flattened condition has eight double-thickness panel sections 52, two at each of the four corners, which lie laterally outwardly of stitch lines 24 and severing lines 30. These double-thickness panel sections 52, which are stiched together as at 36, are generally triangularly shaped, except that one corner of the triangle terminates generally at the severing line 30. However, if the bag has a closed bottom such as illustrated in FIG. 5, then the double-thickness panels designated therein as 54 are of truly triangular shape.

When the bag is to be filled with material it is desirable to support at least the upper end of the bag in an opened condition. For this purpose the double-thickness panels 52 at the upper end of the bag are each slitted, as at 56. The function of the slits 56 is illustrated in FIG. 6. When the bag is to be filled with material, it is supported on retaining rods 58 of a suitable bag support which supports the bag vertically with its upper end in the expanded condition. The bag is arranged on the rods as shown in FIG. 6 with the rods extending through the slits 56. When the upper end of the bag blank is spread apart as shown in FIG. 6, it is automatically formed into a rectangular shape. The four upper corners of the bag are defined by the intersection of the stitch lines 24 with the side edges of panels 14,16 and the spout 42 automatically assumes a generally rectangular shape. When the panels 14,16 are spread apart, the gusset panels 18,20 automatically fold outwardly so that the portions of panels 14,16 below the four upper corners of the bag form the side walls of the bag and the portions of the gusset panels 18,20 below the four corners fold outwardly to form the end walls of the bag.

The top wall of the bag is formed by four panels of generally trapezoidal shape. Two of these panels are single-thickness portions of panels 14,16 which lie between stitch lines 24. These top wall portions are designated 60. The other two single-thickness panel portions which form the top wall of the bag comprise the portions of gusset panels 18,20 which also lie between stitch lines 24 and are designated 62 (FIG. 6). The double-thickness panels 52 overlie the single-thickness panels 62.

Before the bag is filled the spout 42 at the bottom end thereof is folded to a collapsed condition and secured by a lace or equivalent means through the eyelets. If the material with which the bag to be filled is in the nature of a granular material then the valve flap 48 may be utilized to overlie the closed bottom spout and thus effectively prevent leakage of material from the bag. As the bag is filled it will gradually expand into rectangular shape and, when filled, will assume the generally cubical configuration shown in FIG. 1. Thereafter, the top spout 42 is folded to a collapsed position and closed as by lacing it through the eyelets. The bag thus closed is illustrated in FIG. 8.

As previously indicated, the closed and filled bag according to the present invention is of generally cubical shape. In view of its construction, it is free standing and adapted to be stacked vertically one upon another. In order to stack the bags vertically or to move them from one location to another it is necessary to lift the bags. Bags constructed in accordance with the present invention are adapted to be lifted in a very convenient manner. For this purpose a generally flat, plastic tube 64 (FIG. 9) is utilized. Tube 64 is preferably extruded or otherwise formed from a material which is at least semi-rigid with some degree of elastic memory. In its normal condition tube 64 is of a flattened configuration with open ends and sized to receive the tine 66 of a forklift truck. The opposite ends of the tube are cut away so as to provide tabs or extensions 68 at the top side of the flattened tube which extend outwardly beyond the lower portion 70 of the tube ends. Tube 64 is inserted across the top of the bag between the single-thickness panels 62 and the double-thickness panels 52. It is directed between these panels so as to overlie the laced closed spout 42 shown in FIG. 10.

Tube 64 has a length preferably slightly greater than the dimension of the bag along the stitched hem 36. In order to retain tube 64 in place after it is arranged on the bag, snap fasteners 72 are provided for engagement with mating snap fasteners 74 on the double-thickness panels 52. Since the tube 64 in its normal condition is open at its ends and extends across the top of the bag at the center thereof, the operator of a forklift truck can easily guide tine 66 thereof into and through tube 64 without requiring the assistance of another person. He merely aligns the forklift tine 66 with one end of tube 64, raises the tine to engage it under the extension 68 of the tube and then directs the tine through the tube. Thereafter, he merely raises the tine to lift the filled bag. It will be appreciated that, although tube 64 may have been completely collapsed by the weight of another filled bag on top of it, it will assume its open condition when it is relieved of such load. It will further be appreciated that the lifting force on the bag is transferred by the diagonal stitch lines 24 to both side walls of the bag and to both end walls of the bag. In this respect the lift arrangement of the present invention is superior to the lift arrangement of other bags which have a lift loop sewn to each of the four upper corners thereof. In the latter case, the lifting force on the bag is concentrated at each of the four corners rather than being distributed throughout the periphery of the bag. By transferring the lift force evenly to all four side panels of the bag, the bag of this invention can be made of a lighter weight fabric than bags where the lift load is applied only to the corners.

It will be appreciated that the lift arrangement described above is not necessarily limited to a bag wherein the upper end thereof is formed in the manner heretofore described. A conventional rectangularly shaped bag, such as indicated at 80 in FIG. 12, can be adapted for lifting in the manner described by securing a top lift panel 82 over the top wall 84 of the bag and inserting a tube 86 (similar to the tube 64 shown in FIG. 9) between the lift panel 82 and the top wall 84 of the bag. In this case, tube 86 may extend substantially across the full width of the top of the bag if it is desired to utilize both tines 66 of the lift truck to raise the bag, or two narrow tubes may be utilized. Lift panel 82 may be secured to the bag when it is initially formed, in which case it will be provided with a central opening 88 to enable filling the bag.

Figure 14:
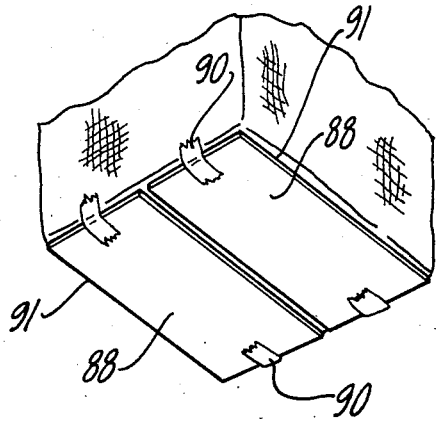
FIG. 14 is a fragmentary perspective view illustrating the utilization of wear resistant panels on the bottom of the bag.

If the bag is intended to be of the reusable type it is desirable, depending upon the environment in which the filled bags are used, to reinforce the bottom of the bags so as to prevent them from becoming worn and the stitching thereon becoming loose. In such event, since the bottom of the bag of this invention is of rectangular shape when filled, a pair of flat wear resistant panels 88, preferably made of a thin plastic material, are secured in any suitable fashion to the portion of the bag blank which, when filled, forms the bottom of the bag. As illustrated in FIG. 14, these panels 88 each overlie one-half the bottom of the bag and extend lengthwise between the two side walls of the bag. In FIG. 14 they are shown secured to the bag by means of tapes 90. However, any other suitable fastening means may be employed. When the bag is emptied and collapsed to its flattened condition, such as shown in FIGS. 2 and 5, the two panels 88 would lie flat against the panels 14,16 with the outer edges 91 generally transversely aligned with the outer ends of the stitch lines 24 or 46 at the lower end of the bag.

Figure 18:
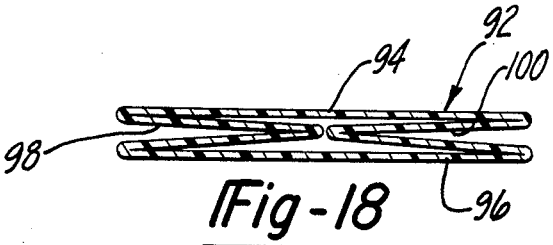
FIG. 18 is a sectional view along the line 18—18 in FIG. 17.

In some instances, depending upon the material which is intended to be placed into the bag, it may be necessary to employ a liner formed of plastic, paper, etc. within the bag. In the case of liquids, for example, a plastic liner would be utilized and in the case of some other materials, a paper liner may be employed. In either event, the bag liner can be formed from a tubular blank with inwardly folded gusset panels in the same manner in which the bag is formed. Thus, the tube blank generally designated 92 in FIG. 18 comprises overlying flat panels 94,96 having inwardly folded gusset panels 98,100. The width of blank 92 is preferably slightly less than that of the bag blank so that the liner will fit within the bag in a flattened condition with the gusset panels 98,100 interleaved with the gusset panels 18,20 of the bag. The liner is hermetically sealed in any suitable fashion along the diagonal lines 102 and along the lengthwise extending lines 104 which, when the liner is arranged within the bag, register with the stitch lines 24 and 26. If desired, the liner can be formed with the double-thickness panels 106 shown at one corner of the liner illustrated in FIG. 16. But, in most instances, since the weight or load of the materials is sustained by the bag itself, not the liner, from the standpoint of bag strength the double-thickness panels 106 are not essential on the liner.

Figure 15:
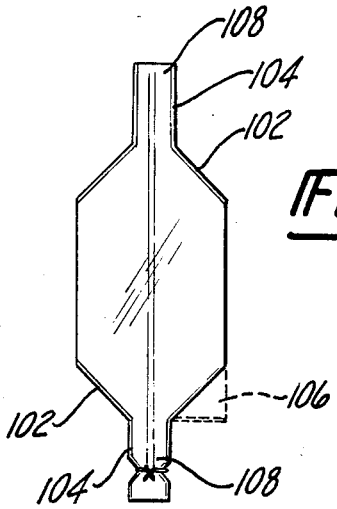
FIGS. 15, 16 and 17 are plan view of various forms of liners that can be used within the bag.
Figure 17:
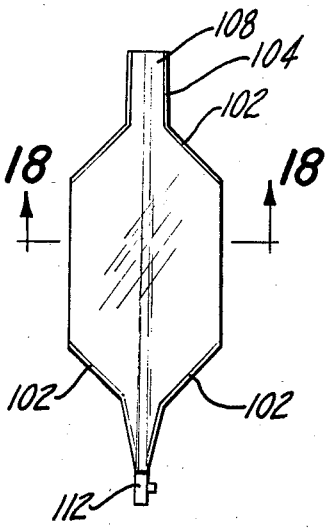
Figure 16:
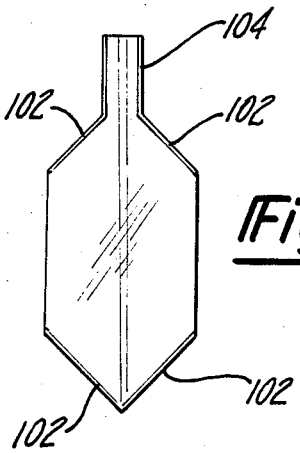

The liner blank is preferably longer than the bag blank so that when the liner is inserted into the bag the spouts 108 of the liner will extend outwardly beyond the spouts 42 of the bag. The liner can be formed with spouts 108 at the upper and lower ends thereof as shown in FIG. 15 or with a spout only at the upper end thereof as shown in FIG. 16. The liner shown in FIG. 16 would be employed with a bag having a closed bottom of the type illustrated in FIG. 5. If desired, the spout at the lower end of the bag can be formed as a tapered dispenser 110, such as shown in FIG. 2, the tip of which can be cut off to discharge the contents of the bag. If the contents of the bag are to be discharged in measured quantities, the spout at the lower end of the bag can be formed with a valve nozzle 112 as shown in FIG. 17. It will be appreciated that, as soon as a portion of the flowable product is discharged through the bottom spout, the lower end of the liner, because of the bottom diagonal seals 102, will assume a tapered funnel shape. This materially assists in preventing "bridging" of the product across the spout as would sometimes occur if the bottom wall of the liner remained flat.

Figure 19:
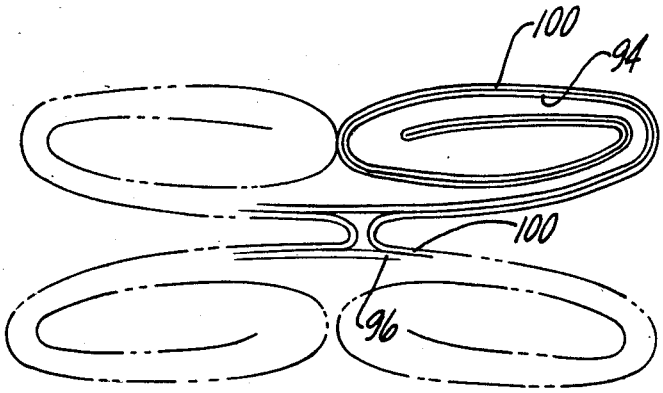
FIG. 19 is an end view illustrating the manner in which the liner is folded for insertion into the bag.
Figure 20:
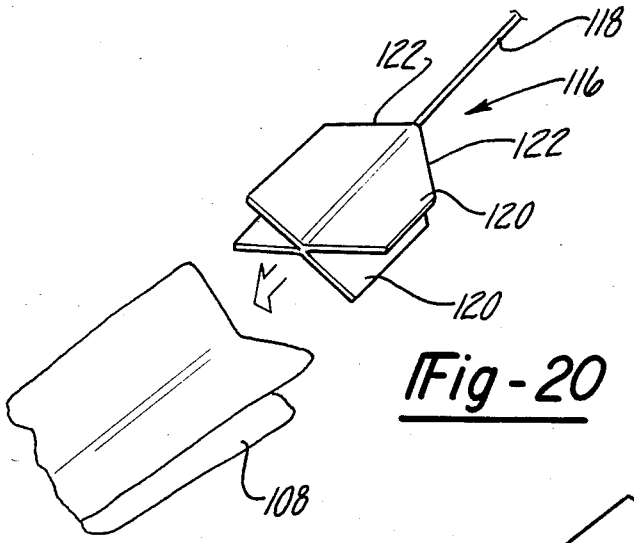
FIGS. 20 and 21 are fragmentary perspective views which illustrate the manner in which the folded liner is inserted into the bag.
Figure 21:
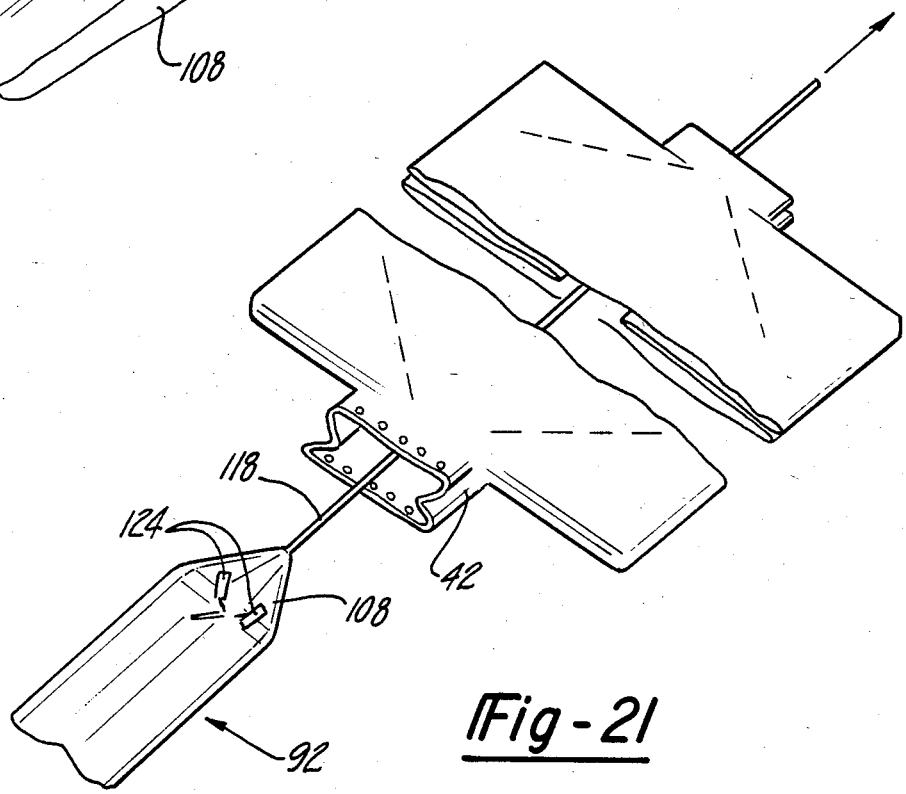
Figure 22:
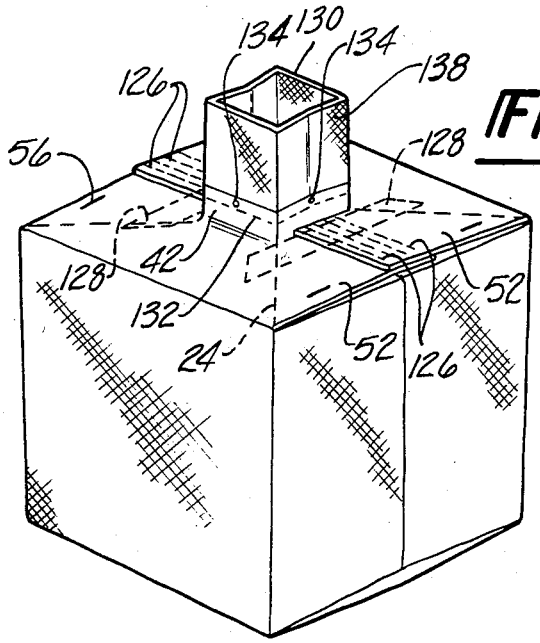
FIG. 22 is a perspective view of a modified form of bag according to the present invention.
Figure 24:
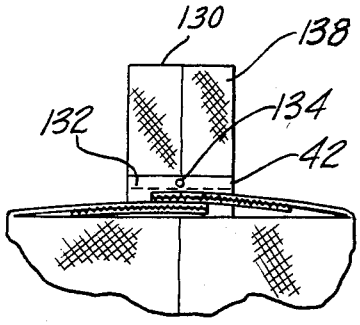
FIG. 24 is a fragmentary elevational view of the upper end portion of the bag shown in FIG. 22.
Figure 23:
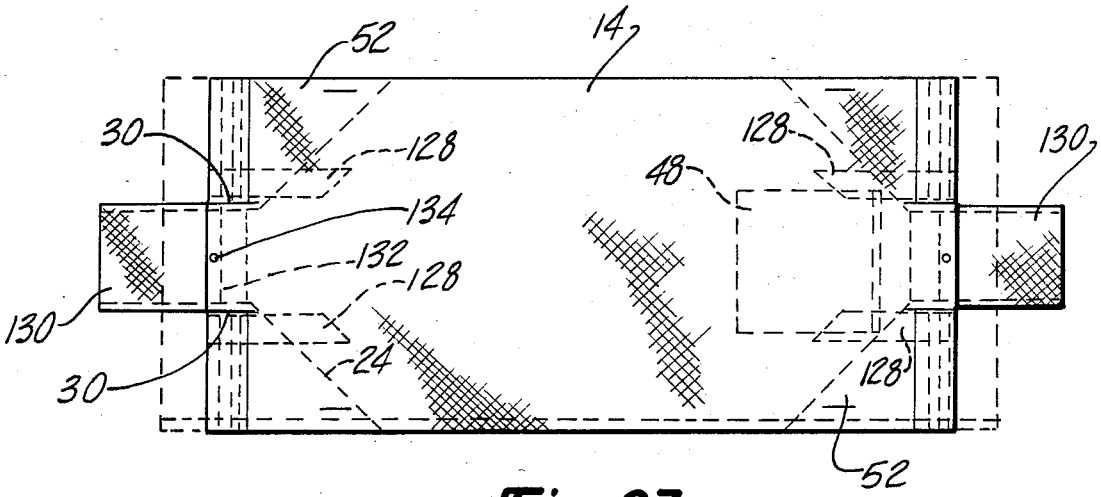
FIG. 23 is a plan view of the bag shown in FIG. 22 in the flattened condition.
Figure 25:
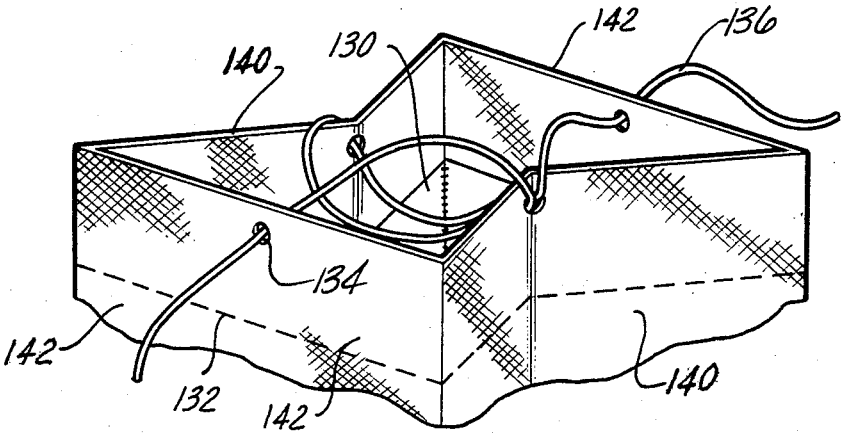
FIG. 25 is a fragmentary perspective view of the spout illustrating the manner in which it can be closed.

In FIG. 20 there is illustrated a tool for facilitating insertion of a flattened folded liner within a flattened bag. The tool generally designated 116 is provided with a handle 118 having a length greater than that of the flattened bag. At its leading end handle 118 has secured thereto four fins or paddles 120. These fins 120 are arranged on handle 118 in two pairs with the fins in each pair slightly inclined to one another as shown in FIG. 20. The finned end of the tool has a width that enables it to be inserted into a spout 108 of a liner. The free ends of fins 120 may be straight, but the edges adjacent handle 118 are preferably angularly inclined as at 122. Tool 116 is designed to draw the liner through the bag from one end to the other. Before the tool is engaged with the liner the liner is folded into the general configuration illustrated in FIG. 19. More specifically, the two panels 94,96 of the liner together with the gusset panels 98,100 are individually folded several times in the manner shown in FIG. 19 so that the width of the folded liner is of a dimension that will enable the liner to be drawn through one of the spouts 42 of the bag when the bag is in the collapsed condition shown in FIG. 21.

After the liner is folded to the configuration shown in FIG. 19 the tool 116 is inserted into one end of the liner, the fins 120 being interleaved with the folded gusset panels 98,100 at the liner spout. Triangular end portions of the liner spout are then folded over the inclined edges 122 of the fins 120 and secured temporarily in place as by adhesive tape strips, as shown at 124 in FIG. 21. This enables the tool to apply a pulling force to the liner. Handle 118 is then directed lengthwise through the bag and pulled therethrough so that the taped end of the liner spout of fins 120 is drawn into the spout at one end of the bag and out through the spout at the other end of the bag. As the folded liner is introduced into the spout of the bag, fins 120 of the tool are interleaved with the gusset panels of the bag and spout so that when the liner is drawn through the bag the gusset panels of the liner remain interleaved with the gusset panels of the bag. After the liner is fully inserted into the bag, the tool is released therefrom and the handle 118 can be inserted into the spout of the liner and manipulated lengthwise and sidewise within the liner to unfold it so that the liner becomes completely interleaved with the flattened bag. With the liner so arranged in the bag, when the bag is filled the liner will automatically expand into cubical shape simultaneously with the expansion of the bag. This avoids the necessity of a separate operation of properly arranging the liner in a conventional bag after the bag is opened to avoid overlapping folds in the liner which, when filled, would stress the liner because it would not conform with the configuration of the filled bag.

The use of a liner in the bag does not interfere in any manner with the use of a tubular member such as shown at 64 and 86 for lifting the filled bag. The liner spout may be closed and collapsed and the bag spout can be closed over the liner spout so as to underlie the tubular member.

Figure 13:
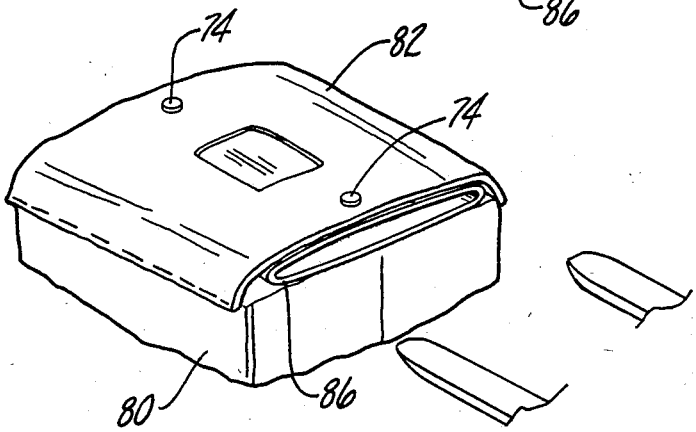
FIG. 13 is a fragmentary perspective view illustrating the manner in which the arrangement shown in FIG. 12 is used.

It will be appreciated that it is not absolutely essential to engage tubes 64 or 86 with the top of the bag only after the bag is filled. If the tube is sufficiently flexible it can be applied to the bag when the bag is initially manufactured. Thereafter the user may simply fold the tube lengthwise one or more times and displace it sidewise to enable the bag spout 48, and the liner spout 108 if a liner is used, to be opened for filling the bag. After the bag is filled and the spouts closed, the tube can be unfolded so as to assume the condition shown in FIGS. 10 and 13 wherein it is adapted to be engaged with the tine of a forklift truck for lifting the filled bag.

The bag illustrated in FIGS. 22 thru 25 differs slightly from that shown in FIGS. 1 thru 11. The same numerals are used to designate the same elements of the bag. One of the differences resides in the manner in which the ends of the double-thickness panels 52 are secured together. In the bag illustrated in FIGS. 22 thru 25 the ends of these double-thickness panels are merely overlapped and then sewn together with a plurality of laterally spaced stitch lines 126 extending through the overlapping portions of these panels. In the case of a bag having a cross section of about three feet square, the overlap is preferably about four inches and is sewn together with about three or four lines of stitching 126. This produces a very strong connection between the panels 52 and is desirable where the bag is intended to carry a very heavy load.

In the case of heavy loads, the stitching on the top wall of the bag, and specifically the diagonal stitching 24, can be further reinforced by incorporating in the side panels 14,16, by weaving or stitching, reinforcing straps 128 adjacent and laterally outwardly of the lines of severing 30. The straps 128 are of a length such as to extend lengthwise of the bag blank and inwardly from each end to beyond the diagonal stitch lines 24. Straps 128 are connected lengthwise to the panels 52 and 60. The provision of straps substantially reduces the stresses upon the stitch lines 24, especially when the bag is lifted.

In the event the bag is intended to be used without a liner and since the spout 42 which may be provided at one or both ends of the bag is relatively short, it is desirable in many instances to sew a tubular extension 130 within the spout. The stitch lines between extension 130 and spout 42 are designated 132. It will be appreciated that the spout extension 130 is initially formed with inwardly folded gusset panels 138 which enables the spout extension to assume the flattened condition illustrated in FIG. 23 before the bag is expanded for use.

It will be noted that the stitch lines 132 are located inwardly of the apertures 134. This enables the spout extension 130 to be folded and tucked into the spout. Then the spout can be closed by threading a cord 136 therethrough in the manner illustrated in FIG. 25. More specifically, each side wall of the rectangular spout 42 has a single aperture 134 and, when the cord 136 is threaded through these apertures in the manner illustrated in FIG. 25, it is merely necessary to pull the two ends of the cord which automatically draws all four sides of the spout together. The cord 136 is threaded through apertures 134 so that, when the ends of the cord are pulled, the gusset portions 140 of the spout are first pulled inwardly toward each other, and thereafter the two remaining sides 142 of the spout are drawn inwardly toward each other to close the spout. The ends of the cord can then be tied into a knot to effectively close the end of the bag.

We claim:

1. A collapsible bag which, when collapsed, comprises a flat tubular blank of a flexible material and having a pair of flat overlying panels adapted to form a pair of opposite side walls of the bag and a pair of folded gusset panels extending inwardly between the flat panels from the opposite side edges of the panels and adapted to form two other opposite side walls of the bag, said blank having adjacent one end thereof each flat panel and the adjacent gusset panel connected together along lines extending diagonally inwardly from the opposite side edges of the panels toward said one end of the tubular blank, said diagonal lines of connection terminating at their laterally inner ends in spaced apart relation laterally outwardly of the inner folded edges of the gusset panels at points spaced from said one end of the blank, each flat panel and the adjacent gusset panel also being connected together along a line extending lengthwise of the blank from said points of termination of the diagonal lines to said one end of the blank, each flat panel and the adjacent gusset panel being severed along lines spaced laterally outwardly of and generally co-extensive in length with said lengthwise extending lines of connection to form, when the blank is opened, a spout of rectangular cross section at said end of the bag, each corner of the spout being defined by one of said lengthwise extending connection lines, the portions of the flat and gusset panels lying between said diagonal connection lines forming, when the blank is open, a generally flat rectangular end wall on the bag with said spout at the center thereof, said diagonal lines of connection extending from the corners of the spout to the corners of said end wall and when said tubular blank is open, said panels provide a bag of generally rectangular cross section with said end wall generally transverse to said panels and having a spout therein and when said tubular blank is collapsed it folds into a generally flat and compact bag.

2. A bag as called for in claim 1 wherein said blank is formed of a plastic material and said connection lines are heat sealed.

3. A bag as called for in claim 1 wherein said blank is formed of a fabric and said connection lines are stitch lines.

4. A bag as called for in claim 1 wherein the portions of said flat and gusset panels adjacent said end of the tubular blank which lie laterally outwardly of said lines of severing are connected together along lines generally perpendicular to the opposite side edges of the flat panels.

5. A bag as called for in claim 4 wherein at each side of said spout the end portion of one of the flat and gusset panels is folded flatwise over the end portion of the other flat and gusset panel so that said end portions are in overlapping relation, said overlapping portions being connected together substantially throughout the extent of overlap.

6. A bag as called for in claim 4 wherein said spout is located at the upper end of the bag, the portions of said flat and gusset panels lying laterally outwardly of and beyond said diagonal connection lines forming double thickness panels which overlie the portions of the gusset panels forming the top wall of the bag.

7. A bag as called for in claim 6 wherein said spout is adapted to be collapsed by folding it into the plane of said end wall when the bag is filled with material and including means for closing the spout.

8. A bag as called for in claim 6 including a separate tubular member formed of at least a semi-rigid material having an elastic memory extending between said top wall and said double-thickness panels over the collapsed spout, said tubular member having an open end disposed adjacent an outer free edge of said double-thickness panels and being of a size to receive the tine of a forklift truck.

9. A bag as called for in claim 8 wherein said open end of the tubular member extends outwardly beyond said outer edge of the double-thickness panel.

10. A bag as called for in claim 8 including reinforcing panels on said flat panels extending lengthwise thereof from said one end past said diagonal connection lines, said reinforcing panels being located closely adjacent said lines of severing.

11. A bag as called for in claim 8 wherein the open end of said tubular member is of flattened configuration and has upper and lower portions, said upper portions extending outwardly beyond said lower portion.

12. A bag as called for in claim 1 wherein the panels at the opposite end of the blank are connected and severed to substantially the same configuration as said one end so that the upper and lower ends of the bag are of the same construction.

13. A bag as called for in claim 1 wherein the opposite end of the bag forms the bottom of the bag and is rectangularly shaped, said bottom having two wear resistant panels secured to the underside thereof, each underlying one half of the bag bottom, said last mentioned panels having juxtaposed inner edges extending along the mid line of the bag bottom between the lower edges of the first mentioned end walls of the bag, said wear resistant panels being adapted to be folded over one another at said juxtaposed edges when the bag is collapsed to its flattened condition.

14. A bag as called for in claim 3 including a liner for said bag comprising a flat tubular blank having overlying flat panels and inwardly folded gusset panels of the same configuration, but slightly smaller than the corresponding panels of the bag, one end of the liner having the flat and gusset panels connected together along lines corresponding to the diagonal and lengthwise stitch lines on the bag and being severed along lines corresponding to the lines of severing on the bag whereby the flattened liner can be drawn through the flattened bag with the gussets and spouts of the bag and liner in interleaved and interfitting relation.

15. A bag as called for in claim 14 wherein the bag is formed with an opening at the opposite end thereof and the liner is formed with a spout at its opposite end adapted to extend through said opening in the bag.

16. A bag as called for in claim 15 wherein the last-mentioned spout comprises a discharge spout at the lower end of the bag and is provided with a valve means for controlling discharge of the material.

17. A bag as called for in claim 6 wherein said double-thickness panels are each formed with a pair of slits therethrough adjacent each of the four corners of the bag, said slits being oriented to accommodate a pair of spreader bars for vertically supporting the bag and maintaining the said end thereof in an expanded condition to permit filling of the bag through said spout.

18. A bag as called for in claim 1 including a panel secured to the inside of the bag in a position to overlie the spout when the bag is filled, said last-mentioned panel being adapted to be displaced from said overlying position to permit discharge of the product through said spout when the bag is oriented so that the spout is at the bottom.

19. A bag as called for in claim 4 including a reinforcing strap at said end of the bag extending lengthwise thereof adjacent and laterally outwardly of each of said lines of severing, said reinforcing straps extending from said end of the flat panels to at least slightly beyond said diagonally extending connection lines, said reinforcing straps being connected with said flat panels throughout the length of the straps.

20. A bag as called for in claim 1 including a spout extension of rectangular cross section extending outwardly of the bag through said spout, said spout extension comprising a pair of opposite side walls and a pair of folded gusset panels extending inwardly between said side walls from the opposite side edges thereof.

21. A bag as called for in claim 20 wherein the inner end of the spout extension is disposed within the spout and is connected thereto inwardly of the free end of the spout so that the extension can be folded into the spout and the spout thereafter folded inwardly over the folded extension to effectively close the end of the bag.

22. A bag as called for in claim 21 wherein said spout has a plurality of openings therein disposed outwardly of the connection between the spout and the extension and through which a cord may be laced to close the end of the spout over the folded spout extension.

23. A bag as called for in claim 8 wherein said double thickness panels comprise fabric panels.

24. A bag as called for in claim 8 wherein said open end of the tubular member extends to an outer free edge of said double thickness panels.

25. A bag as called for in claim 8 wherein said tubular member overlies said filling spout.

* * * * *